United States Patent [19]

Moen

[11] 3,997,116

[45] Dec. 14, 1976

[54] ADJUSTABLE SHOWER HEAD

[75] Inventor: Alfred M. Moen, Grafton, Ohio

[73] Assignee: Stanadyne, Inc., Elyria, Ohio

[22] Filed: Oct. 28, 1975

[21] Appl. No.: 626,034

[52] U.S. Cl. ..... 239/460; 239/587; 285/269

[51] Int. Cl.[2] ..... B05B 1/18

[58] Field of Search ..... 239/460, 587, 582, 583, 239/600; 285/166, 184, 376, 276, 375, 277, 267–269

[56] References Cited

UNITED STATES PATENTS

| | | | |
|---|---|---|---|
| 1,011,284 | 12/1911 | Utz et al. | 285/375 |
| 1,899,119 | 2/1933 | Singer | 285/269 X |
| 2,285,831 | 6/1942 | Pennypacker | 239/460 |
| 2,848,255 | 8/1958 | Klein et al. | 285/276 X |
| 2,935,265 | 5/1960 | Richter | 239/587 X |
| 3,319,982 | 5/1967 | Schwartz | 285/267 X |
| 3,384,307 | 5/1968 | Moen | 239/460 |
| 3,420,497 | 1/1969 | Wilcox | 285/277 X |
| 3,826,429 | 7/1974 | Moen | 239/460 |
| 3,887,136 | 6/1975 | Anderson | 239/460 |

*Primary Examiner*—Robert S. Ward, Jr.
*Attorney, Agent, or Firm*—Kinzer, Plyer, Dorn & McEachran

[57] ABSTRACT

An adjustable shower head has a pivotal attachment of the body of the shower head to a conventional swivel or ball member which includes a releasable retainer interlocked to the shower head in a tamperproof manner. At the discharge end of the shower head there is a removable spray forming member and means for creating water pressure behind the spray forming member to maintain it in an appropriate spray forming position.

8 Claims, 5 Drawing Figures fig.1.
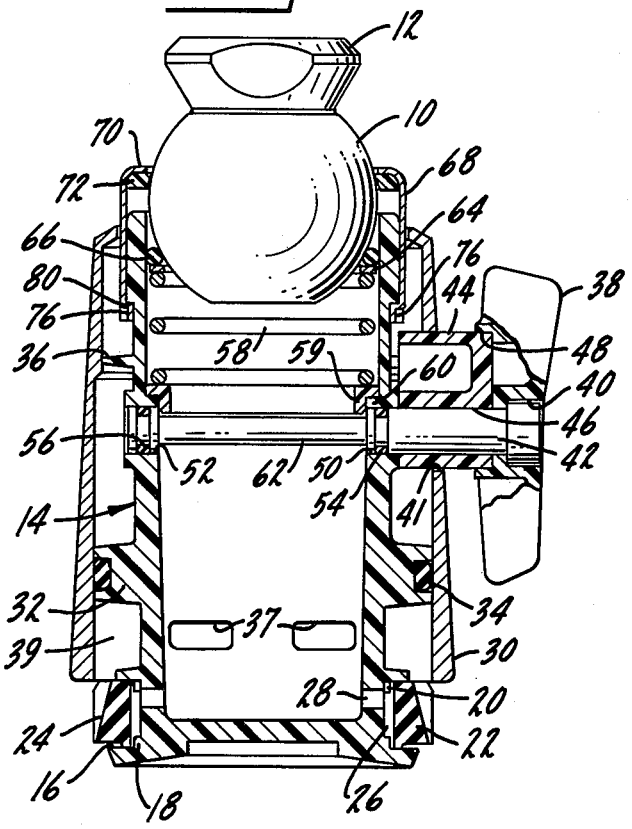
fig.2.
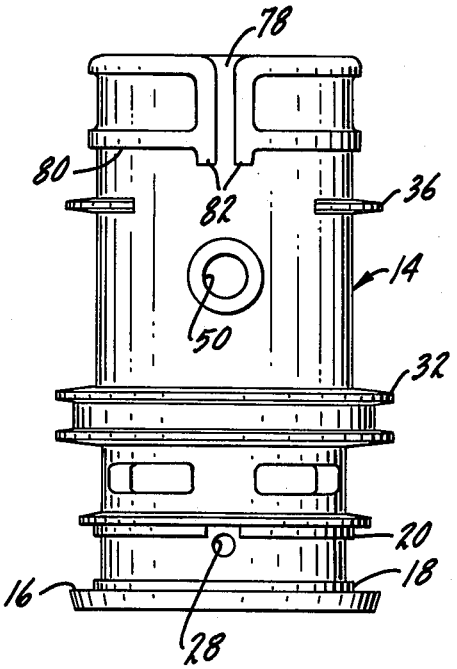
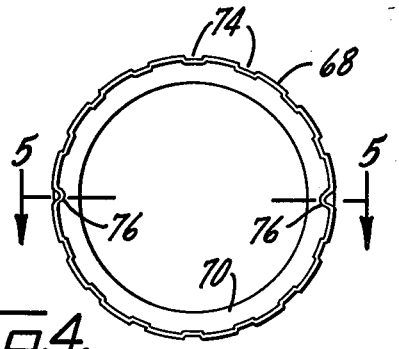
fig.4.
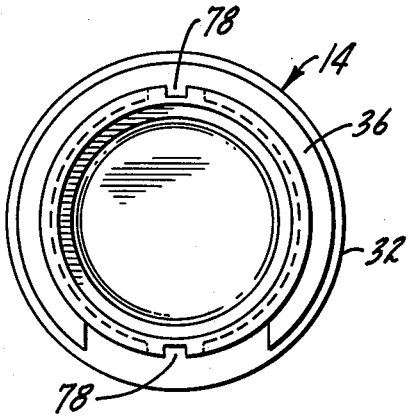
fig.3.
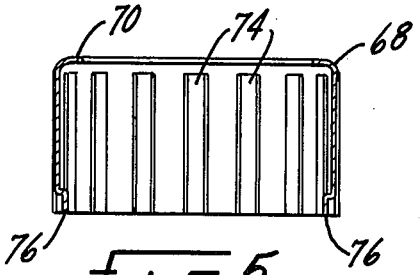
fig.5.

ADJUSTABLE SHOWER HEAD

SUMMARY OF THE INVENTION

The present invention relates to a shower head and in particular to improvements in the means for attaching an adjustable shower head to a swivel and in the means for maintaining the spray forming member of the shower head in proper disposition during operation.

One purpose of the present invention is a means for attaching the body of a shower head to the swivel or ball member which is tamperproof.

Another purpose is an adjustable shower head including a releasable retainer interlocked in a unique manner to the ball member or swivel.

Another purpose is a shower head of the type described including a water chamber behind the spray forming member to maintain it in appropriate spray forming position.

Other purposes will appear in the ensuing specification, drawings and claims.

BRIEF DESCRIPTION OF THE DRAWINGS

The invention is illustrated diagrammatically in the following drawings wherein:

FIG. 1 is a partial axial section through a shower head of the type described,

FIG. 2 is a side view of the body member,

FIG. 3 is a top view of the body member,

FIG. 4 is a bottom view of the retainer, and

FIG. 5 is a section along plane 5—5 of FIG. 4.

DESCRIPTION OF THE PREFERRED EMBODIMENT

The present invention is directed to improvements in the shower head disclosed in my prior U.S. Pat. No. 3,826,429. Specifically, the means for attaching the body of the shower head to the swivel provide a tamperproof installation, and the means for maintaining water pressure behind the spray forming member maintain this element in proper disposition for forming an appropriate spray.

In FIG. 1 a ball member 10 may have a conventional internal passage for conveying water from a water conduit which is attached to the fitting end 12 of the ball member 10. A body member indicated generally at 14 is generally tubular in form and has an external groove 16 at its downstream end. Spaced shoulders 18 and 20 are formed in groove 16 and are used to position a spray forming member 22. The spray forming member may be formed of a sealing material such as rubber or one of the common rubber substitutes as described in the above mentioned U.S. patent. The exterior of the spray forming member may have a series of grooves 24 which may be formed in accordance with the construction shown in U.S. Pat. No. 3,384,307. The shoulders 18 and 20 cooperate with the interior surface of spray forming member 22 to define a chamber 26 which is in communication with the interior of body member 14 through a pair of generally oppositely disposed water passages 28. Upper shoulder 20 may be removed in the areas directly adjacent water passages 28 so as to provide unobstructed flow of water from the inside of the body member to chamber 26.

A sleeve 30 is movably mounted on body member 14 and positioned relative to the body member by means of a body member annular projection 32 having a groove which holds a seal ring 34 bearing against the interior surface of sleeve 30. A second outwardly-extending projection on the body member is indicated at 36, with this projection bearing against the upper interior surface of sleeve 30.

Body member 14 may have a series of water openings 37 upstream of spray forming member 22 which communicate with a space 39 defined between the body member and the sleeve.

An adjusting knob is indicated generally at 38 and has an opening 40 to receive a pin 42. A cam or eccentric is indicated at 44 and has an opening 46 to receive pin 42 and is attached to handle 38 by means of a recess 48. Sleeve 30 has an opening 41 for cam 44. Thus, rotation of handle 38 is effective to reciprocally move sleeve 30 relative to the discharge end of the body member and to variably position the inside surface of sleeve 30 with respect to spray forming member 22 to vary the amount and direction of water passing through grooves 24.

Pin 42 passes through an opening 50 in one side of body member 14 and through an opening 52 in the opposite side. Pin 42 may carry seal rings 54 and 56 which seal against the interior surfaces of openings 50 and 52 respectively.

Positioned within the upper end of body member 14 is a coil spring 58, the lower end of which rests upon a collar 59 which in turn is supported on an inwardly-directed flange 60 which is integral with body member 14. Note particularly, as indicated in FIG. 1, when collar 59 is seated upon flange 60, the lower end of the collar extends inside of recessed portion 62 of pin 42, thus preventing removal of the pin and knob 38 from the shower head.

A ring 64 is seated upon the upper end of spring 58 and carries a seal ring 66 which bears against the exterior surface of ball 10. A retainer is indicated at 68 and has an upper inwardly extending flange 70 which fits about a ring 72 bearing against ball member 10. Ring 72 has an inner diameter slightly less than the diameter of ball 10. Retainer 68 may have a plurality of equally spaced grooves 74, provided for decorative purposes, and may have a pair of oppositely disposed inwardly directed projections 76.

The exterior of body member 14 has a pair of oppositely disposed grooves 78 which will receive projections 76 when the retainer is assembled onto body member 14. As shown particularly in FIG. 2, the lower end of each groove 78 terminates at a position axially spaced from the lower surface of an annular shoulder 80 which extends circumferentially about the body member except for the spaced portions 82 which define the terminus of groove 78.

When the shower head is attached to the ball 10, the retainer is first slipped over the ball so that ring 72 will be above the major diameter of the ball and thus cannot be pulled downwardly off of the ball. The retainer will be moved downwardly or toward the body member with projections 76 moving through grooves 78. Near the end of this movement spring 58 will be compressed. Once the retainer has been moved fully down upon the body member, the retainer is rotated until the projections 76 are away from areas 82 and thus in a position to be moved into contact with shoulder 80. Spring 58, once the retainer is released, will then urge the retainer and body member in opposite directions so that projections 76 will rest against shoulder 80, thus preventing disassembly of the shower head from swivel or ball 10. In this manner the shower head is tamperproof in that it may not be removed from the swivel by a person without knowledge of the manner in which it has been assembled. Any attempt to axially move the body member will not release it from the swivel nor will rotational movement. Only an individual having knowledge of the method of assembly will be able to coordinate axial and rotational movement of the retainer to remove the body member and thus the shower head from ball 10.

Of importance is the arrangement whereby chamber 26 which is formed behind spray forming member 22 provides an outwardly directed water pressure created force upon the spray forming member to keep it in proper disposition relative to the inside surface of sleeve 30. Thus, there will always be a spray type of discharge and not a sheet discharge which could result if the spray forming member were not urged outwardly against the inside surface of sleeve 30.

Whereas the preferred form of the invention has been shown and described herein, it should be realized that there may be many modifications, substitutions and alterations thereto.

The embodiments of the invention in which an exclusive property or privilege is claimed are defined as follows:

1. In an adjustable shower head, an elongated generally tubular body member, a sleeve movably mounted on the exterior of said body member, a spray forming member attached to the downstream end of said body member, water discharge openings in said body member upstream of said spray forming member, the interior of said sleeve being variably positionable relative to the exterior of said spray forming member to vary the discharge therefrom, a ball member at the upstream end of said body member, and means for pivotally and releasably attaching said body member to said ball member including a retainer, a ring carried by said retainer and having an inner diameter less than the diameter of said ball member and bearing thereagainst, said retainer having a pair of oppositely positioned projections on the interior thereof, a pair of cooperating oppositely positioned grooves on the exterior of said body member, spring means positioned in said body member and biased against said body member and ball member, circumferential shoulder means on the exterior of said body member and axially spaced from the terminus of the axially extending grooves on the exterior of said body member, axial relative movement between said retainer and body member causing said retainer projections to move in said axial grooves, with subsequent rotary relative movement between said retainer and body member causing said projections to move away from said grooves, said spring means thereafter urging said projections against said shoulder means, thereby interlocking said retainer and body member.

2. The structure of claim 1 further characterized in that said shoulder means extend generally circumferentially about said body member.

3. The structure of claim 1 further characterized in that said spring means is supported within said body member at one end thereof and bears effectively against said ball member at the other end thereof.

4. The structure of claim 1 further characterized by and including an annular groove adjacent the downstream end of said body member, said spray forming member being removably recessed into said groove, and at least one water passage in said body member connecting the interior thereof with the interior surface of said spray forming member.

5. The structure of claim 4 further characterized by and including an annular chamber formed between the interior surface of said spray forming member and said body member groove, said water passage opening into said annular chamber.

6. In an adjustable shower head, an elongated generally tubular body member, a ball member at the upstream end of said body member and means for pivotally attaching the body member to the ball member, a sleeve movably mounted on the exterior of said body member, an annular groove adjacent the downstream end of said body member, a separate spray forming member formed of a yielding distortable material removably recessed into said groove, a chamber formed by said groove and the interior circumferential surface of said spray forming member, water passages connecting said chamber with the interior of said body member, water discharge openings in said body member upstream of said spray forming member, the interior of said sleeve being variably positionable relative to the exterior of said spray forming member to vary the discharge therefrom.

7. The structure of claim 6 further characterized in that the pivotal attachment of said body member and ball member includes a retainer releasably attached to said body member, a ring carried by said retainer and having an inner diameter less than the diameter of said ball member and bearing thereagainst, oppositely disposed grooves in an exterior portion of said body member and cooperating inwardly-directed projections on said retainer for use in attaching said retainer to said body member.

8. In a shower head, a generally tubular body member, means at one end of said body member for forming a water discharge, a ball member at the upstream end of said body member, and means for pivotally and releasably attaching said body member to said ball member including a retainer, a ring carried by said retainer and having an inner diameter less than the diameter of said ball member and bearing thereagainst, said retainer having a pair of oppositely positioned projections on the interior thereof, a pair of cooperating oppositely positioned grooves on the exterior of said body member, spring means positioned in said body member and biased against said body member and ball member, circumferential shoulder means on the exterior of said body member and axially spaced from the terminus of the axially extending grooves on the exterior of said body member, axial relative movement between said retainer and body member causing said retainer projections to move in said axial grooves, with subsequent rotary relative movement between said retainer and body member causing said projections to move away from said grooves, said spring means thereafter urging said projections against said shoulder means, thereby interlocking said retainer and body member.

* * * * *